United States Patent [19]

Fockens

[11] Patent Number: 4,686,517

[45] Date of Patent: Aug. 11, 1987

[54] FIELD DISTURBANCE DETECTION SYSTEM

[75] Inventor: Tallienco W. H. Fockens, GV Eibergen, Netherlands

[73] Assignee: N.V. Nederlandsche Apparatenfabriek NEDAP, De Groenlo, Netherlands

[21] Appl. No.: 615,240

[22] Filed: May 30, 1984

[51] Int. Cl.[4] ..... G08B 13/14

[52] U.S. Cl. ..... 340/572; 342/42

[58] Field of Search ..... 340/572, 551, 552; 343/6.8 R, 6.8 LC, 6.5 SS, 5 TM; 342/42

[56] References Cited

U.S. PATENT DOCUMENTS

| | | | |
|---|---|---|---|
| 3,798,642 | 3/1974 | Augenblick et al. | 340/572 |
| 3,810,147 | 5/1974 | Lichtblau | 340/572 |
| 3,868,669 | 2/1975 | Minasy | 340/572 |
| 3,984,835 | 10/1976 | Kaplan et al. | 343/6.5 SS |
| 4,023,167 | 5/1977 | Wahlstrom | 343/6.5 SS |
| 4,117,466 | 9/1978 | Lichtblau | 340/572 X |
| 4,356,477 | 10/1982 | Vandebult | 340/572 |
| 4,499,564 | 2/1985 | Sirai | 340/552 |

FOREIGN PATENT DOCUMENTS 1570877 7/1980 United Kingdom .

*Primary Examiner*—James L. Rowland
*Assistant Examiner*—Jeffery A. Hofsass
*Attorney, Agent, or Firm*—Fleit, Jacobson, Cohn & Price

[57] ABSTRACT

An electromagnetic detection system is described which, in operation, in a detection zone, by means of at least one transmission antenna coil, generates a swept-frequency interrogation field capable of being at least partly absorbed by a responder comprising a tuned circuit, if such responder is present in the detection zone. Detection means are provided, coupled with the transmission antenna coil to detect such absorption. According to the invention the detection means comprises means for eliminating spurious frequencies located outside the band of the swept frequency, said means comprising a mixer including a first input to which a signal from the transmission antenna coil is supplied, and a second input to which the output signal from a sweeper feeding the transmission antenna coil is supplied, and including an output connected with a low-pass filter.

3 Claims, 8 Drawing Figures

A
B $f_w$
$f_o$
$f_i$
$f_w$
$f_o$
A
B

A
B

A
B

A
B

FIELD DISTURBANCE DETECTION SYSTEM

BACKGROUND

The invention relates to an electromagnetic detection system which, in operation, in a detection zone, by means of at least one transmission antenna coil, generates a swept-frequency interrogation field capable of being at least partly disturbed by a responder comprising a tuned circuit, if such responder is present in said detection zone, there being provided detection means coupled with at least one detection antenna coil for detecting such disturbance.

Such systems are already known in various embodiments. In general two types of field disturbance detection systems may be distinguished. Systems of the first type are based on absorption of interrogation field energy by the tuned circuit of the responder. Absorption takes place selectively, i.e. at a pre-determined frequency or frequency band because the responder comprises a tuned circuit. Owing to the selective absorption the energy content of the transmission circuit is modulated, which modulation can be detected by means of an envelope detector, which is connected to the transmission antenna coil and which may be a simple diode. This envelope detector then issues a pulse in the form of the resonance curve of the tuned circuit of the responder. This form is known and so the detected pulse can be compared with the known form. Thus, in this case the detection antenna coil is (one of) the transmission detection coil(s).

As an alternative in a system of the absorption type a separate detection antenna coil (or receiver antenna coil) for monitoring the energy content of the interrogation field may be used. Selective absorption of energy by the tuned circuit of the responder results in a pulse-shaped disturbance of the interrogation field and thus in a pulse-shaped variation of the output signal of the detection antenna coil. This pulse-shaped variation can again be detected by suitable detection means coupled to the detection antenna coil.

In systems of the second type (transmission systems) one or more separate receiver coils are used to detect signals retransmitted by the responder. Preferably the receiver antenna coils are positioned in such manner, that they do not directly detect the interrogation field, but only detect signals retransmitted by a responder, which generally has an orientation differing from the orientation of the transmitter antenna coil(s). In such a system transmission of energy occurs from the transmitter antenna coil(s) to the responder and from the responder to the receiver antenna coil(s) (detection antenna coil(s)) when the interrogation field frequency equals the resonance frequency of the tuned circuit of the responder. Again the presence of a responder may be detected by detection means coupled to the receiver (detection) antenna coil(s).

One disadvantage of the known system(s) is that other high-frequency signals not coming from a responder associated with the system can be detected by the detection antenna coil(s) and may cause the generation of a pulse at the output of the envelope detector. These signals may have frequencies located outside the sweep of the swept interrogation frequency or within this range.

Such signals are respectively called out-band signals and in-band signals.

OBJECTS AND SUMMARY

It is an object of the invention to overcome the disadvantage outlined above and generally to provide an effective detection system of the kind described in which the risk of a false alarm from spurious signals is minimized.

For this purpose, according to the invention, a detection system of the kind described is characterized in that said detection means comprises means for eliminating spurious frequencies located outside the band of the swept frequency, said means comprising a mixer including a first input to which a signal from the detection antenna coil(s) is supplied, and a second input to which the output signal from a sweeping oscillator feeding said transmission antenna coil(s) is supplied, and including an output connected with a low-pass filter.

BRIEF DESCRIPTION OF DRAWINGS

One embodiment of the invention will now be described, by way of example, with reference to the accompanying drawings, in which.

DETALED DESCRIPTION

Figure 1:
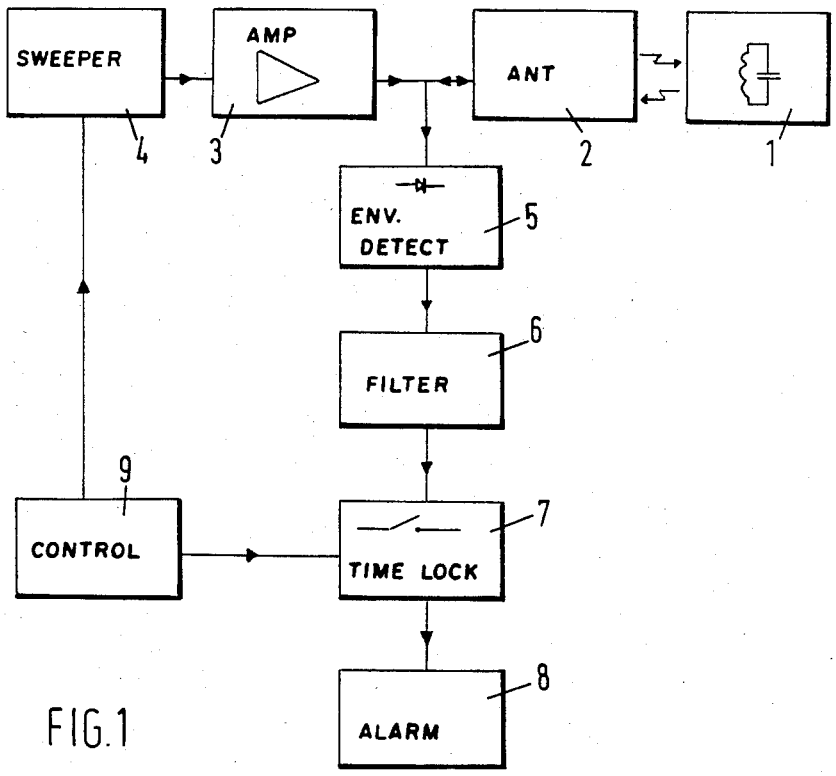
FIG. 1 PRIOR ART
FIG. 1 shows diagrammatically a system of a known kind.

FIG. 1 shows a known detection system as may be used, for example, for detecting theft in shops, and which is based on the absorption of energy from an interrogation field by a tuned circuit.

The shop articles or other goods to be protected, which may not be brought outside a defined area without permission, are provided with a responder with a tuned circuit 1.

In the vicinity of the exit(s) of the shop or other space, an interrogation field is generated by at least one frame antenna 2 to form a detection zone. The frame antenna is energized via an amplifier 3 by a known per se sweeper 4, whose frequency sweep comprises the resonance frequency of the tuned circuit 1.

The frame antenna 2 is further connected to a circuit capable of detecting the change in voltage across the antenna, caused by the absorption of field energy by a tuned circuit 1. This circuit comprises an envelope detector 5, an analogue filter 6, a time lock device 7 and an alarm device 8.

Sweeper 4 is controlled by a control device 9 to provide the desired frequency sweep. The control device also controls the time lock device, so that it can be determined whether a detector pulse indeed occurs at the correct moment, that is to say at the moment when the swept frequency passes the resonance frequency of the tuned circuit. If this is the case, the alarm device is actuated.

As stated before, in spite of the presence of the analogue filter device and the time lock device, false alarm signals may yet occur as a result of the out-band signals.

According to the invention this effect can be overcome by detection with direct conversion (the homodyne principle). In this system the detection antenna signal is supplied to a balanced mixer, and so is the transmission signal supplied by the amplifier to the antenna(s). The mixer forms the product of the two signals, and the frequency of the output signal is the difference between the frequency of the detection antenna signal and the frequency of the transmission signal. Out-band signals lead to relatively high frequencies of the output signal from the mixer, and can be removed in a simple manner by means of a low-pass filter.

Figure 2:
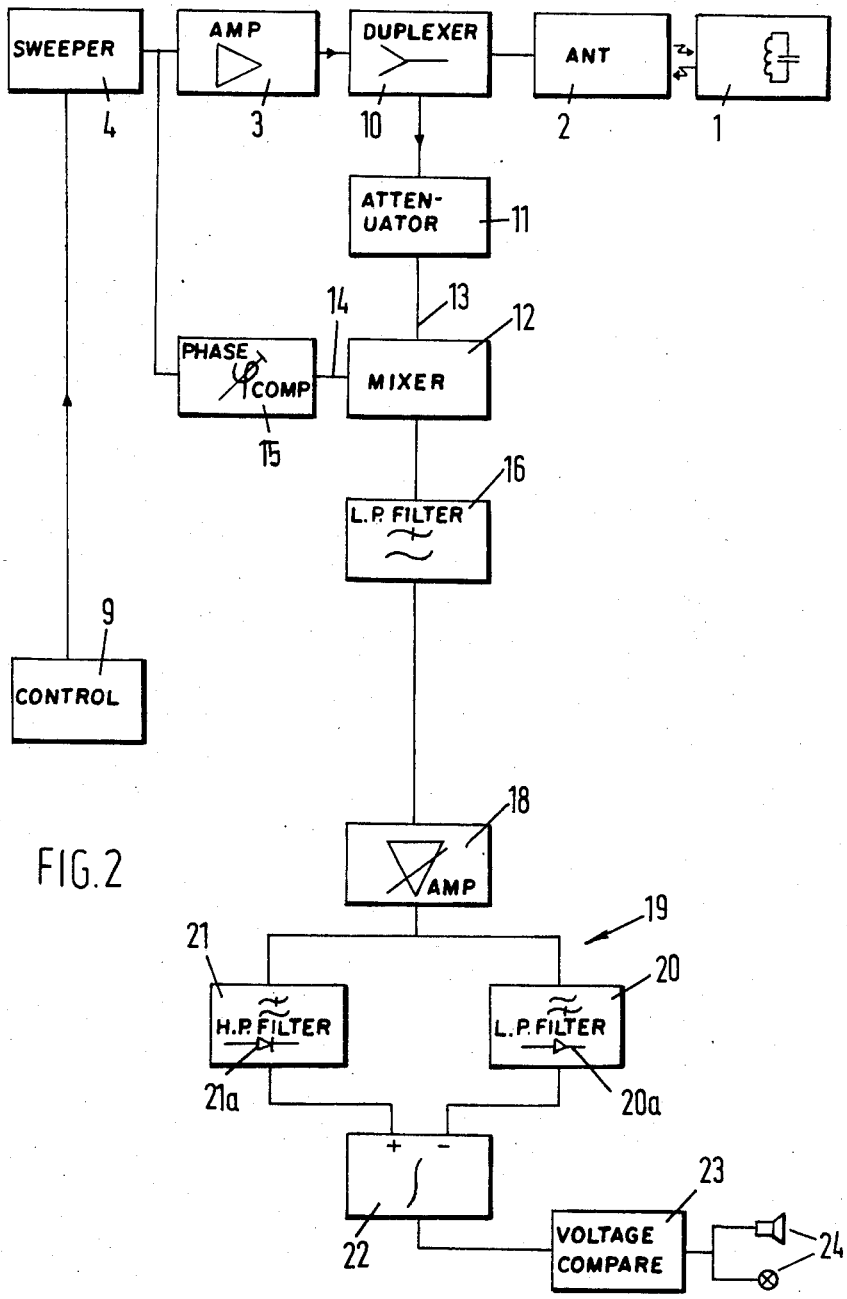
FIG. 2 shows diagrammatically an embodiment of a system according to the present invention.

FIG. 2 shows diagrammatically a system of the absorption type arranged to suppress the effects of out-band signals and, as will be explained hereinafter, the effects of spurious in-band signals.

FIG. 2 again shows an antenna device 2, consisting of one or more antennas, for example frame antennas, which device is fed via an amplifier 3 with the signal from a high-frequency sweeper 4, whose frequency continuously varies over a frequency range comprising the resonance frequency of the tuned circuit 1, and this in such a manner that even when there is a spread in the resonance frequency of the tuned circuit as a result of tolerances in the components, these frequencies still fall amply within the frequency sweep of the sweeper.

The output signal from the amplifier is supplied via a duplexer 10 to the antenna(s) The duplexer is in addition, if desired via an attenuator 11, connected to a mixer 12 in order to supply the antenna signal to the mixer.

If a tuned circuit 1 is present in the detection zone created by the antenna device in the form of an interrogation field, at the moments when the swept frequency of the interrogation field passes the resonance frequency of the tuned circuit, the antenna device and the tuned circuit become magnetically coupled in such a manner that the tuned circuit absorbs energy from the interrogation field. As a result the voltage across the antenna coil(s) is decreased.

As a consequence the voltage across the antenna coil(s) temporarily decreases each time the field frequency passes the resonance frequency of the tuned circuit 1. This, in practic modulates the antenna signal in amplitude and in phase, to produce side-band frequency components relative to the field frequency.

Accordingly, the mixer receives at a first input 13 a signal comprising the field frequency and side-band frequencies.

Furthermore, the mixer receives at a second input 14, via a phase compensation network 15, directly the output signal from the sweeper.

The output signal from the mixer then comprises the side-band frequency components transformed to a carrier wave frequency of zero Hertz (direct conversion).

The output signal from the mixer may further comprise outband signals originating from outside the system. After the direct conversion these spurious signals give rise to high-frequency signals, which are removed by means of a low-pass filter 16.

The signal passed by the low-pass filter is supplied to an amplifier 18, which is adjustable to control the sensitiveness of the system. The amplifier 18 may be provided with an automatic gain control circuit (known per se) in order to obtain an automatic gain adjustment depending upon the level of the input signal.

The output signal from the amplifier is supplied to a discriminator filter device 19, serving to separate signals from a tuned circuit 1 from spurious signals having a frequency within the sweep of the sweeper (in-band noise).

Figure 3:
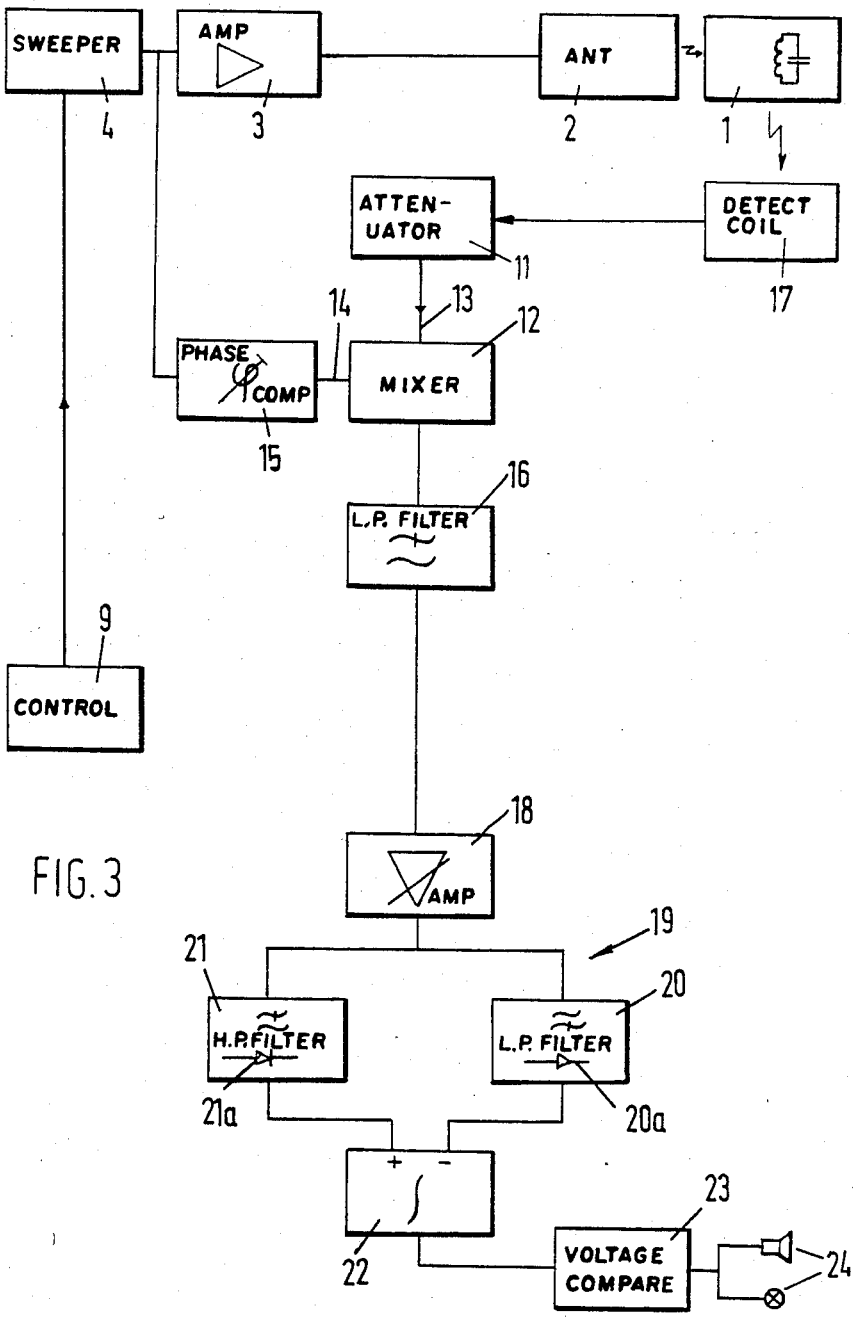
FIG. 3 shows diagrammatically an alternative embodiment of a system according to the invention.

FIG. 3 diagrammatically shows a system according to the present invention in which, however, at least one separate detection coil 17 has been used. This system either may be of the absorption type or of the transmission type. In other respects the system of FIG. 3 is similar to the system of FIG. 2. Of course, because of the fact that a separate detection coil is used the duplexer 10 is no longer necessary.

The discriminator filter device operates as follows.

Suppose that a spurious signal, for example a radio signal is received with a frequency close to the resonance frequency of the tuned circuit 1. As a result of this spurious signal, the mixer issues an output signal with a frequency that is the difference between the spurious frequency fi and the frequency of the sweeper fo. When the sweeper sweeps through the frequency range, this frequency difference will first decrease to zero Hertz and then increase again (see FIGS. 4A and 5A).

Figures 4, 5, 6, 7, 8:
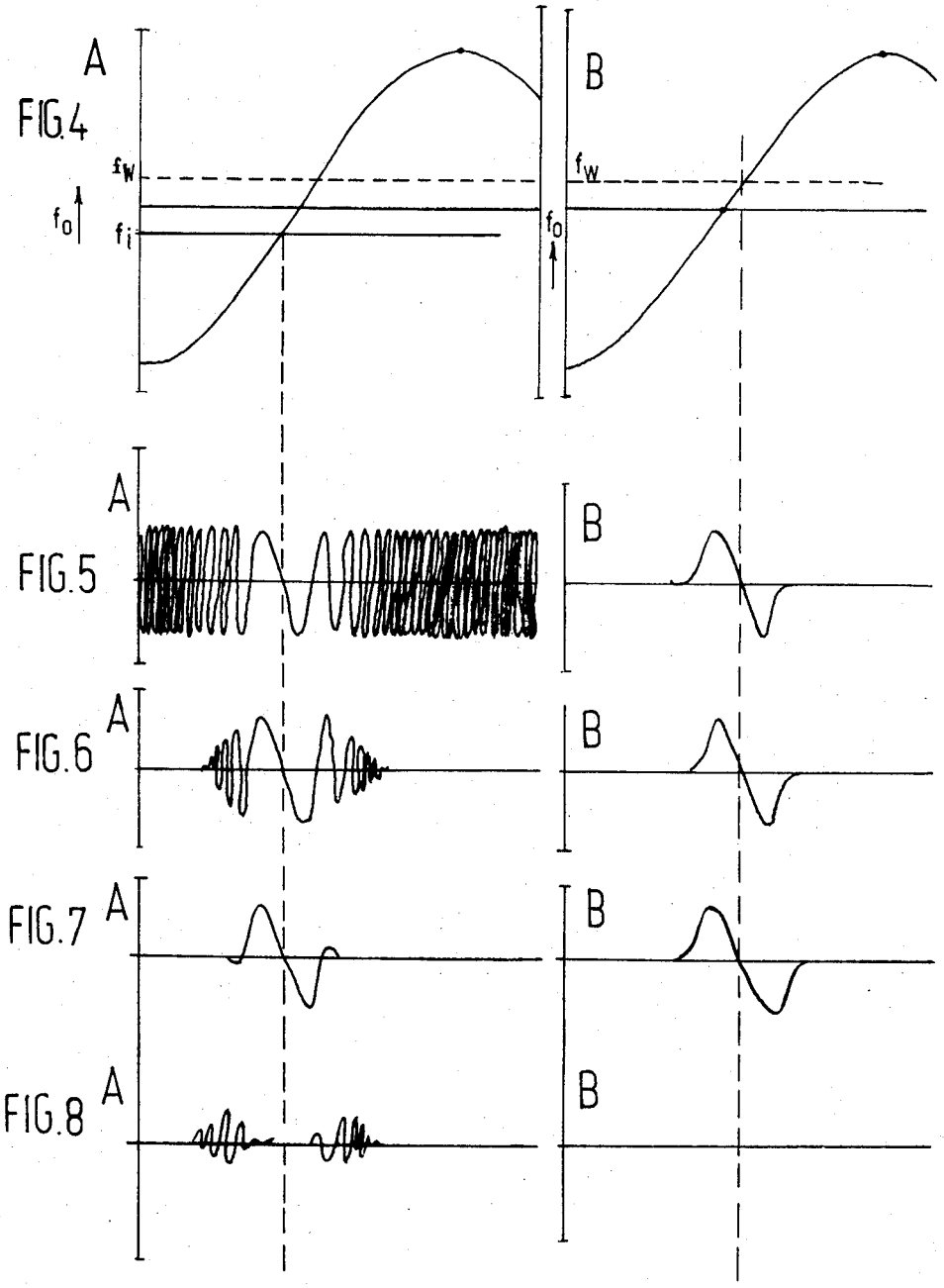
FIGS. 4–8 show some signal forms which may occur in a system according to the invention.

The low-pass filter 16 is a barrier to signals having higher frequencies, so that the signal shown in FIG. 6A remains at the output of the low-pass filter.

FIGS. 4B, 5B and 6B show, in comparison with a spurious signal, a signal fw coming from a tuned circuit 1. With a proper selection of the cut-off frequency of the low-pass filter 16, the spurious signal will exhibit some excursions with a higher frequency than a signal coming from a responder.

In the discriminator filter device, the higher-frequency excursions are separated from the low-frequency excursions. For this purpose there is provided in the discriminator filter device a low-pass filter 20 and a parallel-connected high-pass filter 21. In this way a separation is effected between a signal from a responder and a spurious radio signal.

FIGS. 7A and 7B show the output signal from the low-pass filter 20 for a spurious signal and a signal from a responder, respectively.

FIGS. 8A and 8B show the corresponding output signals from the high-pass filter 21.

Other spurious signals, such as noise, pulse-shaped interference, etc., produce higher-frequency signal components in the discriminator filter. After the separation the signal components are separately rectified. For this purpose filters 20 and 21 are provided with rectifiers 20*a* and 21*a*. The two D.C. voltages are supplied to an integrator circuit 22 in such a manner that the integrator output voltage is going to increase as a result of low-frequency signals. Signals from the high-frequency channel of the discriminator filter cause the integrator output voltage to decrease, however, and this in such a manner that when both signal components appear the integrator output voltage also decreases.

The integrator is followed by a voltage comparator 23, which produces an actuating pulse to an alarm device 24 as soon as the output voltage exceeds a predetermined threshold value. The rise time of the integrator is preferably such that about ten sweep periods in which a signal from a responder is received are required to actuate the alarm signal.

It is noted that various modifications of the circuits described herein by way of example will readily occur to those skilled in the art. It should be understood that such modifications are within the scope of the present invention.

I claim:

1. An electromagnetic detection system which, in operation, in a detection zone, by means of at least one transmission antenna coil, generates a swept-frequency interrogation field as a continuous wave field capable of being at least partly disturbed by a responder comprising a tuned circuit, if such responder is present in said detection zone, there being provided a detection means coupled with at least one detection antenna coil for detecting such disturbance, characterized in that said detection means comprises: means for eliminating spurious frequencies located outside the band of the swept frequency, said means for eliminating comprising a mixer including a first input, to which a deteced signal from the detection antenna coil(s) is supplied, and a second input to which an output signal from a sweeper generating said continuous wave field and feeding said transmission antenna coil(s) is supplied, and including an output connected with a low-pass filter, said mixer mixing substantially all of the detected signal with the continuous wave output signal, a discriminator filter means for separating signals from a responder that are passed by said low-pass filter and spurious signals that are passed by said low-pass filter and have a frequency close to the frequency of the responder signals, by means of a second low-pass filter and a high-pass filter parallel-connected with said second low-pass filter, and a first rectifier for rectifying the output signals from the second low-pass filter, and a second rectifier for rectifying the output signals from the high-pass filter, and that the output signals from the first and second rectifier are respectively supplied to a first and second input of an integrator.

2. An electromagnetic detection system according to claim 1, characterized in that a signal at one input of the integrator effects an increase in the output signal from the integrator, and a signal at the other input of the integrator effects a decrease in the output signal from the integrator.

3. Apparatus according to claim 2, characterized in that the output from the integrator is connected via a level detector to alarm means, said level detector issuing an actuating signal for said alarm means when the output signal from the integrator has reached a predetermined level.

* * * * *